US009513087B2

(12) United States Patent
Barger

(10) Patent No.: US 9,513,087 B2
(45) Date of Patent: Dec. 6, 2016

(54) FIREARMS ATTACHMENT SYSTEM

(71) Applicant: Overland Safety Systems, LLC, Goffstown, NH (US)

(72) Inventor: John J. Barger, Webster, NH (US)

(73) Assignee: Overland Safety Systems, LLC, Goffstown, NH (US)

( * ) Notice: Subject to any disclaimer, the term of this patent is extended or adjusted under 35 U.S.C. 154(b) by 0 days.

(21) Appl. No.: 14/341,463

(22) Filed: Jul. 25, 2014

(65) Prior Publication Data

US 2015/0075054 A1 Mar. 19, 2015

Related U.S. Application Data

(60) Provisional application No. 61/858,198, filed on Jul. 25, 2013, provisional application No. 61/864,230, filed on Aug. 9, 2013, provisional application No. 61/932,690, filed on Jan. 28, 2014.

(51) Int. Cl.
*F41C 27/00* (2006.01)
*F41G 11/00* (2006.01)

(52) U.S. Cl.
CPC ..... *F41G 11/003* (2013.01)

(58) Field of Classification Search
CPC ..... F41C 27/00; F41C 23/16; F41G 11/003; F41A 35/00; F41A 23/16; F41A 23/08; F41A 23/10; F41A 23/18; F41A 23/00
USPC ..... 42/90, 106; 89/1.1, 37.01, 37.04, 37.03
See application file for complete search history.

(56) References Cited

U.S. PATENT DOCUMENTS

| | | | | |
|---|---|---|---|---|
| 8,341,866 | B1 * | 1/2013 | Gaddini et al. | 42/72 |
| 9,021,728 | B1 * | 5/2015 | Kocmich et al. | 42/1.06 |
| 2007/0180752 | A1 * | 8/2007 | Houde-Walter | 42/114 |
| 2010/0170133 | A1 * | 7/2010 | Swan | 42/85 |
| 2011/0173868 | A1 * | 7/2011 | Wilson | 42/95 |
| 2011/0239512 | A1 * | 10/2011 | Kleven | 42/85 |
| 2014/0047755 | A1 * | 2/2014 | McClintock | 42/90 |
| 2014/0215889 | A1 * | 8/2014 | Abdennour et al. | 42/94 |
| 2014/0252187 | A1 * | 9/2014 | Petrovic | 248/229.16 |

OTHER PUBLICATIONS

Yankee Hill Machine Co., Inc; https://web.archive.org/web/20130222090523/http:/www.brownells.com/optics-mounting/rings-mounts-amp-bases/rifle-bases/ar-15-m16-mini-riser-assembly-prod23256.aspx; Feb. 22, 2013.*

* cited by examiner

*Primary Examiner* — Joshua Freeman
(74) *Attorney, Agent, or Firm* — Loginov & Associates, PLLC; William A. Loginov

(57) ABSTRACT

A firearms attachment system for installation on a firearm with an integral rail system is provided with a riser assembly that secures to the weapon and a mounting base assembly. The riser assembly has a riser and two retaining bolts that secure it to the rail system by passing through the slots between the ribs of the rail system. The riser assembly has a central groove that receives the rail and shoulders that fully hold the rail when slidably engaged. The retaining bolts maintain the desired orientation. The mounting base assembly is comprised of the base and the locking assembly. The base has a groove to receive the riser. When the riser assembly is affixed to the rail assembly, the weapons system can be slidably engaged with the mounting base assembly. The lock assembly impels a retaining bolt into the bottom of the riser, to prevent removal of the weapon.

9 Claims, 12 Drawing Sheets

FIREARMS ATTACHMENT SYSTEM

RELATED APPLICATIONS

This application claims the benefit of U.S. Provisional Application Ser. No. 61/858,198, filed Jul. 25, 2013, entitled FIREARMS ATTACHMENT SYSTEM, U.S. Provisional Application Ser. No. 61/864,230, filed Aug. 9, 2013, entitled FIREARMS ATTACHMENT SYSTEM, and U.S. Provisional Application Ser. No. 61/932,690, filed Jan. 28, 2014, entitled FIREARMS ATTACHMENT SYSTEM, the entire disclosures of which are herein incorporated by reference.

FIELD OF THE INVENTION

The field of this invention relates to firearms locks and more particularly, to firearms locks that are mounted within a vehicle or a structure.

BACKGROUND OF THE INVENTION

Law enforcement, paramilitary and military vehicles transport officers and soldiers into potentially hazardous environments. It is common that these individuals will bring both personally worn weapons and additional weapons, including shotguns, assault rifles, submachine guns, and other tactical weapons. When an officer, agent or soldier requires additional firepower, they turn to readily available weapons that are carried within the vehicle in a vehicle mounted rack. The simplest of racks include a simple u-shaped clamp that is biased so as to provide a frictional hold on the stock and/or barrel of the weapon. However, these racks are constructed to accommodate traditional weapons having a stock and action. Modern law enforcement and military weapons now include fore grips that are mounted on the barrel that can accommodate one or more mountable accessories, including laser sighting systems, illumination devices and other mechanisms.

Accessory mounts for weapons began with the development of the Weaver rail mount system that was the first standardized scope mount for rifles. The mount was improved in the 1980s and became the Picatinny rail system, a universal accessory system for military and paramilitary weapons. The Picatinny rail device has now relocated the fore grips on many military and paramilitary weapons systems. Today, one or more accessories can be mounted, including but not limited to tactical lights, laser aiming modules, night vision devices, reflex sights, fore grips, bipods and bayonets. Picatinny rails and accessories have relocated iron sights in the design of many firearms and are now incorporated into pistol frames and grips. Picatinny rail device locking slot dimensions are standardized such that the slot width is 5.23 mm. The slot centers are spaced apart by 10.01 mm. Weaver rail mount system slots are less standardized, but have a uniform slot width of 4.57 mm. Accessories can be attached and detached by sliding them onto the rail from one end or the other, by clamping with bolts, thumbscrews or levers; or onto the slots between the raised sections or the rails.

It would be desirable to provide a firearms attachment system that can be mounted onto a wall or other vertical or non-vertical support member, or onto or inside a vehicle that can interengage with a Picatinny rail device, Weaver rail mount or other accessory rail mount system and thereby removably secure the weapon to the lock. It would be further desirable to provide an attachment system to which further accessories can be removably attached.

SUMMARY OF THE INVENTION

This invention overcomes the disadvantages of the prior art by providing a firearms attachment system for installation on a firearm with an integral rail system is provided with a riser assembly that is secured to the weapon and a mounting base assembly. The firearms attachment system for a weapon is comprised of a riser assembly defining a rail receiving slot for receiving a weapon rail system, the riser assembly defining a guide hole; at least one retaining bolt that passes through the guide hole to engage with a rail of the weapon rail system; a mounting base assembly having a base and a locking assembly, the base defining a groove that engages with and receives the riser assembly and being securable to a structural member; and a locking assembly that selectively secures the riser assembly with respect to the base in the closed position. The rail receiving slot is open along its top, resides upon a base shoulder mount and is bordered along its sides by opposing riser shoulders. The riser assembly is removably attachable to the a rail of a weapon rail system by connection of the weapon system rail with the rail receiving slot. The riser assembly is removably attached to a top rail of the weapon rail system by connection of the weapon system rail with the rail receiving slot. The riser assembly is removably attached to a side rail of the weapon rail system by connection of the weapon system rail with the rail receiving slot. The riser assembly is removably attached to a mounting base assembly that is anchored to an operational accessory support arrangement. The riser assembly defines a central well that is configured to receive and retain a mount for a weapons sling. A method for the attachment and detachment of a weapon accessory to a weapon having a riser attached to a rail of a weapons rail system is comprised of engaging a firearm attachment system with the rail of the weapon rail system by passing the weapon rail system rail into a rail receiving slot; securing the firearm attachment system to the weapons rail system rail by inserting threaded locking bolts into guide holes located with the firearm attachment system and passing the threaded locking bolts through slots in the weapon rail system; and engaging the weapon accessory with the firearm attachment system by placing a weapons accessory rail receiving slot onto the firearm attachment system. The weapon accessory can be a sling swivel pin with a central well.

BRIEF DESCRIPTION OF THE DRAWINGS

The invention description below refers to the accompanying drawings, of which.

DETAILED DESCRIPTION

Figure 1:
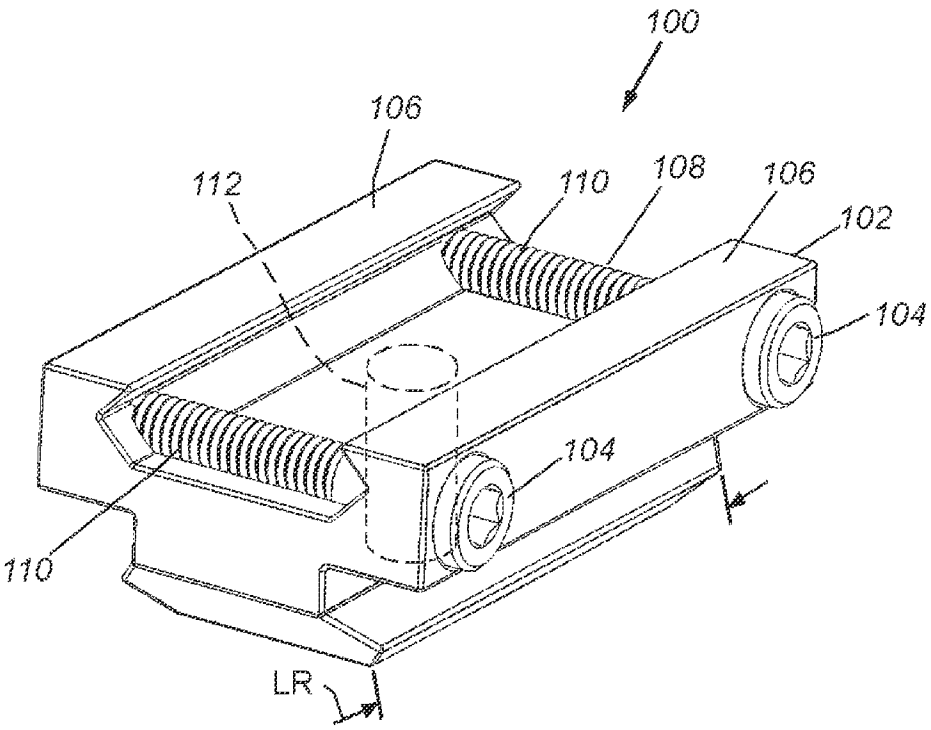
FIG. 1 is a perspective view of an exemplary riser assembly, according to an illustrative embodiment.

FIG. 1 is a perspective view of an exemplary riser assembly 100, according to an embodiment, the riser assembly 100 is provided with a riser body 102 and at least one riser locking bolt 104. The riser assembly 100 is provided with two bolts 104 in the illustrative embodiment. In other embodiments there can be one bolt or three or more bolts 104. The riser bolts 104 are through-bolts that extend from a riser shoulder 106, across the rail receiving slot 108 to an opposing riser shoulder 106. The rail receiving slot 108 is open along its top, resides upon the base shoulder mount 230 and is bordered along its sides by opposing riser shoulders 106. The bolts 104 engage with a Picatinny rail rib (not shown) and promote the maintenance of a proper seating and interconnection of the riser assembly 100 and the rail (not shown). The riser assembly 100 can be constructed of a cast metal, such as zinc alloy, aluminum alloy, or other lightweight metal that is machined and/or forged. In various embodiments, the gate and/or riser assembly 100 can be cast from a synthetic polymer, a ceramic, a fiber (glass, carbon, nylon, etc.) composite, or a combination thereof. The riser assembly 100 can be provided with an applied finish (for example, a powder coating or bluing) or another finish, or none at all. The riser assembly 100 serves as a removable connective interface between the weapon and the firearms lock base. The riser assembly 100 is located over the end of a Picatinny rail without the locking bolts and slid down the rail until it is at a desired position. The locking bolts 104 are then inserted into their respective guide holes 110 and passed through the guide holes and tightened. A riser retaining bolt 112 (shown in broken lines and described more fully hereafter) is tightened to create and maintain a confronting force onto the rail that in conjunction with the locking bolts 104 provides a secure fit for the riser and rail. The length LR of the riser is approximately 2 to 2.5 inches. In other embodiments, the length can be greater or lesser and can vary based on the materials used in its fabrication. The rail receiving slot 108 is sized appropriately to the fixed dimensions of the rail system employed and sized to receive the rail without impingement.

Figure 2:
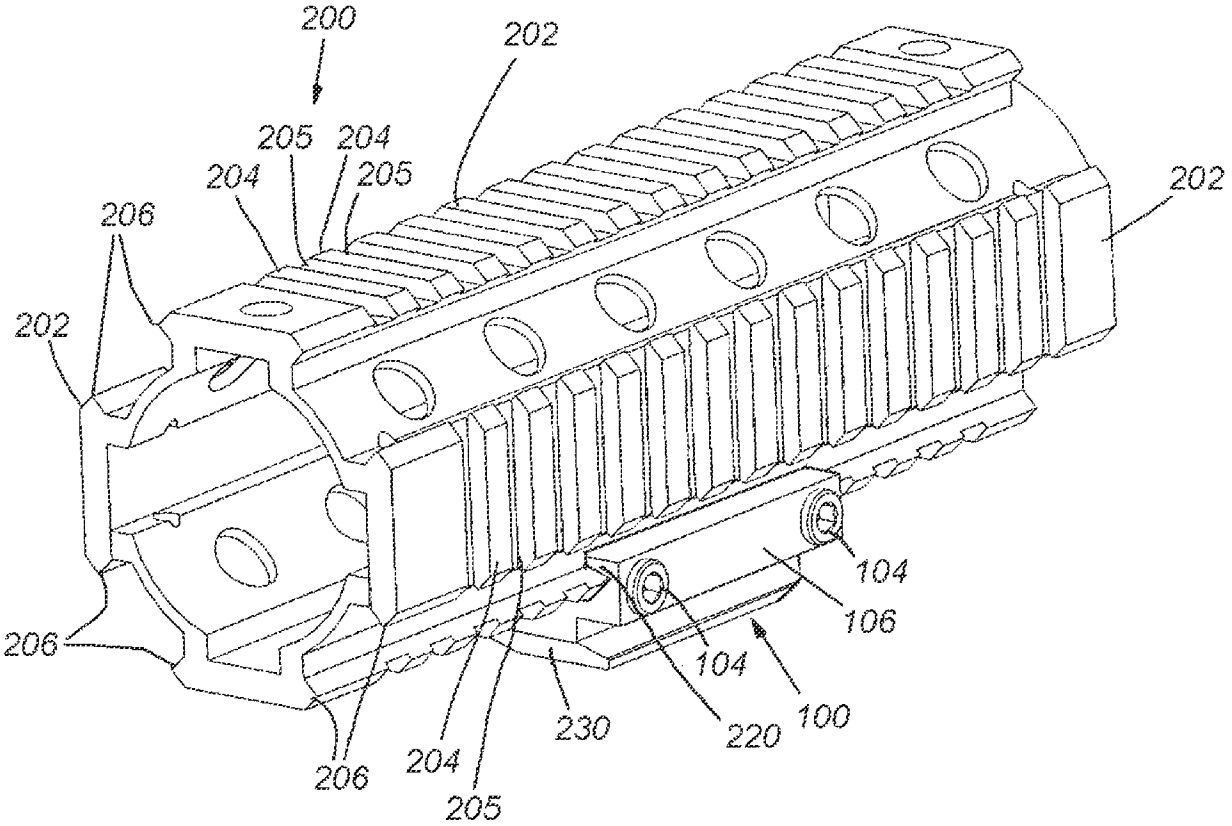
FIG. 2 is a perspective view of the riser assembly of FIG. 1 mounted onto a rail system, according to the illustrative embodiment.

FIG. 2 is a perspective view of the riser assembly 100 mounted onto a rail system 200. The rail system 200 is comprised of four rail assemblies 202, each of which is provided with ribs 204 and slots 205 situated between the ribs, according to the designs of the rails. Each rail 202 is provided with a pair of counterpoised shoulders 206. The shoulders 206 are dimensioned according to the specifications of the particular rail system and are engaged by the inner riser shoulders 220. The locking bolts 104 pass through the respective slot 205 and are spaced apart in a distance corresponding to the placement of the slots in a particular rail system. To attach and detach a weapons accessory to a weapon having a riser attached to a rail assembly, a user engages the firearms attachment system with the rail of the weapon rail system and secures the firearms attachment system to the weapons rail system rail by inserting threaded locking bolts into the guide holes and passing the threaded locking bolts through slots in the weapon rail system and engages the weapons accessory to the firearms attachment system. Given that the rail systems 200 are situated so that they are located on the top, bottom and sides of the weapon (not shown), the riser assembly 100 can be attached to any of the rails at any position, front to center and rear, as desired by the operator. Furthermore, the riser assembly 100 is dimensioned so as not to interfere with any of the sighting systems of the weapon and thus, will not block any of the operator sight pictures. The riser assembly 100 is provided with a base shoulder mount 230 that engages a mounting base assembly (not shown).

Figure 3:
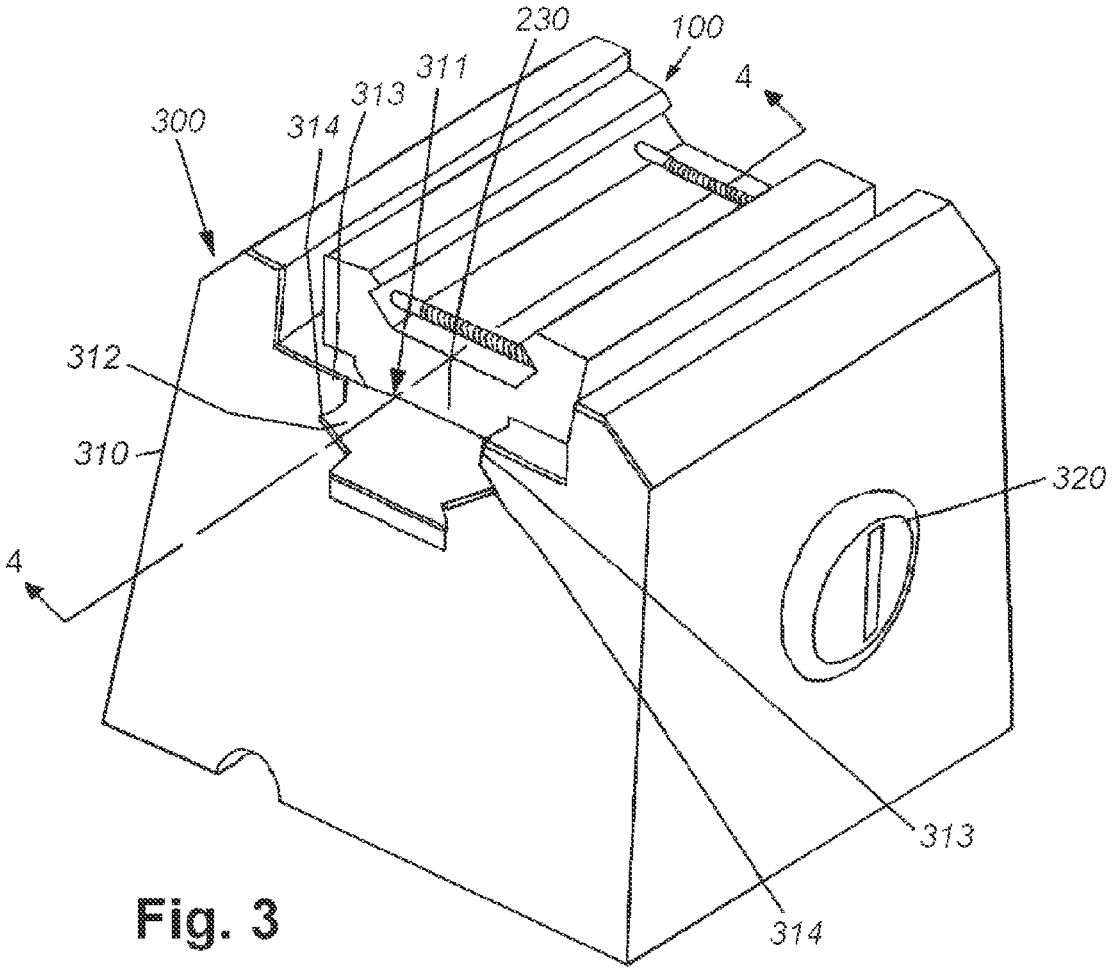
FIG. 3 is a perspective view of the riser assembly engaged with a mounting base assembly, according to the illustrative embodiment.

FIG. 3 is a view of the riser assembly 100 as connected to the base mounting assembly 300. The base mounting assembly is comprised of a mounting base 310 and a locking tumbler system 320. The base 310 has a plurality of mounting through-holes 312 for affixing the base mounting assembly 300 to a structural member in a vehicle or building. Given that the base mounting assemblies 300 and riser assemblies 100 are relatively interchangeable, an operator can situate one base mounting assembly in a work/duty station structure and another in a vehicle and provide the weapon with one riser assembly attached to the rail system so as to be able to remove the weapon from the duty station mounting base and place it into the vehicle, and vice-versa, while maintaining physical security for that weapon. The base mounting assembly 300 is defines a receiving groove 311 located on the top for removably engaging the riser assembly 100. This groove 311 is configured to have shoulders 313 and side grooves 314 that receive and retain the base shoulder mount 230 when the riser assembly 100 is slid from either end of the groove 311.

Figure 4:
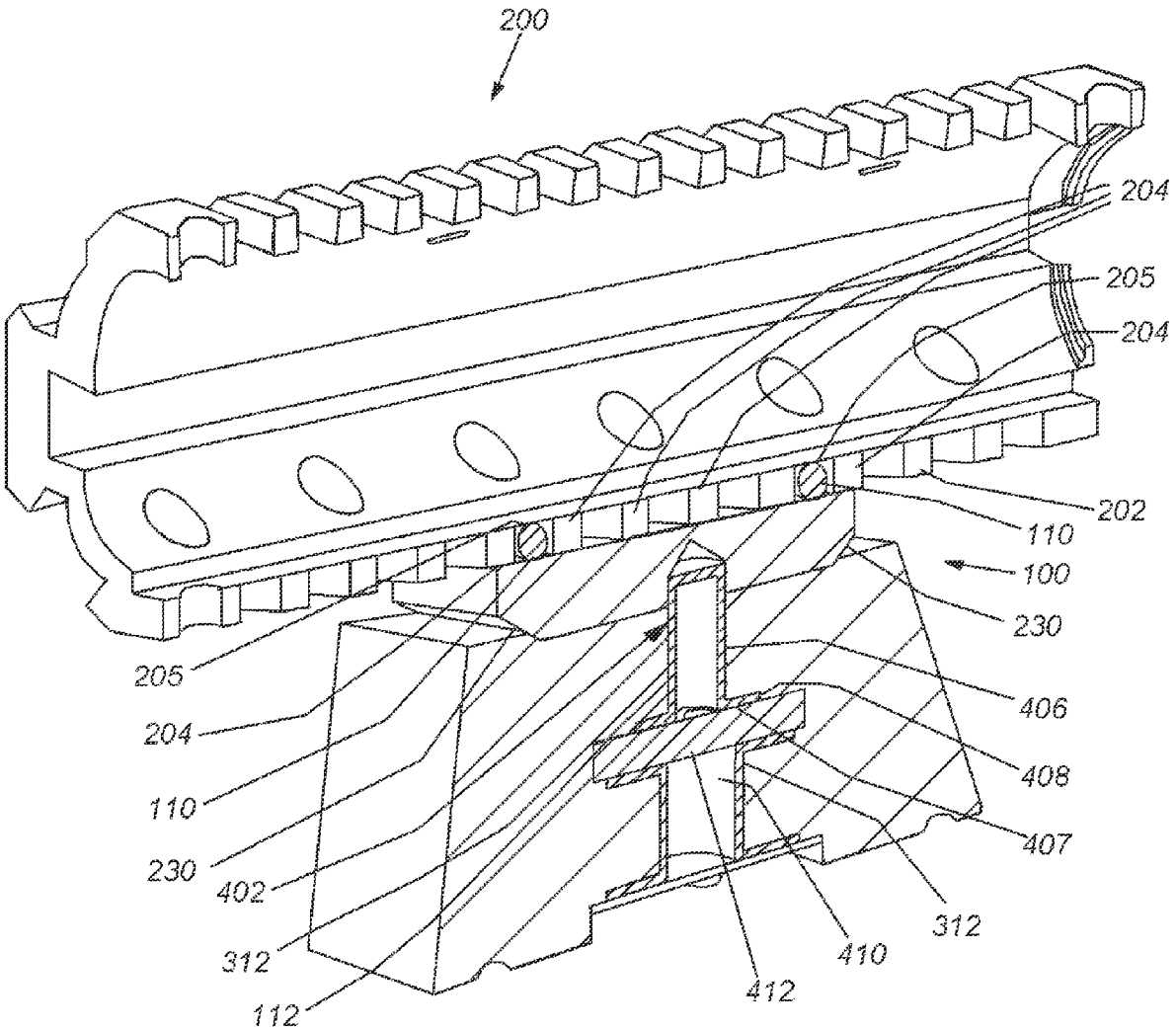
FIG. 4 is a cross-section view taken along lines 4-4 of FIG. 3 with an engaged rail system, according to the illustrative embodiment.

FIG. 4 is a cross-section view along lines 4-4 of FIG. 3 with a weapons rail system engaged to the riser assembly 100 that is in turn secured to the mounting base assembly 300. The locking bolts 110 are nestled into the respective slots 205 between the adjoining ribs 204. This prevents the riser assembly 100 from slipping to the front or rear of the engaged rail. The base shoulder mount 230 is depicted as angular and uniformly sloped so as to ease sliding the riser assembly into the mounting base assembly during engagement. In other embodiments, the slope can be curvilinear and/or bull-nosed. The riser assembly is provided with the riser retaining bolt 112 that is situated within the bolt channel 402 that is an inset hole within the bottom of the riser assembly but does not pass fully through. When the mounting base is locked, the retaining bolt 112 is mechanically and/or electronically impelled upwards into the channel so as to engage the riser assembly 100. If the retaining bolt is actuated by a solenoid or other electromechanical (or other motive force) actuator, then the mounting base assembly can include a battery well and energy storage batteries. The lock can be switched in a variety of ways, including a hidden switch within the vehicle or a biometric interface, keypad, or other access system mounted on, or adjacent to the system.

The combination of the raised retaining bolt 122 and locking bolts 110 and the engagement of the base shoulder mount 230 within the groove 311 prevents the engaged weapon from being slid out of or pulled laterally out of the mounting base, creating a secure locking device. The retaining bolt 112 moves within a bolt channel 402 that has a circumferential base wall 406 with a bottom shoulder 408 that engages the bolt base 407 and arrests its movement within the channel 402. When the lock assembly (not shown) is disengaged, the bolt base 407 rests on the upper surface 412 of the channel plug 410. The channel 402 and its internal components rest against the surface of the structural member when the mounting base 300 is secured to the structural member and is not accessible to tampering or sabotage. The dimensions of the riser assembly 100 and mounting base assembly 300 are sized to resist external tampering with ordinary entry tools, such as chisels, screw drivers, pry bars and hammers. The duration of that resistance varies, based on the materials used and the overall strength of the supporting structural member.

Figure 5:
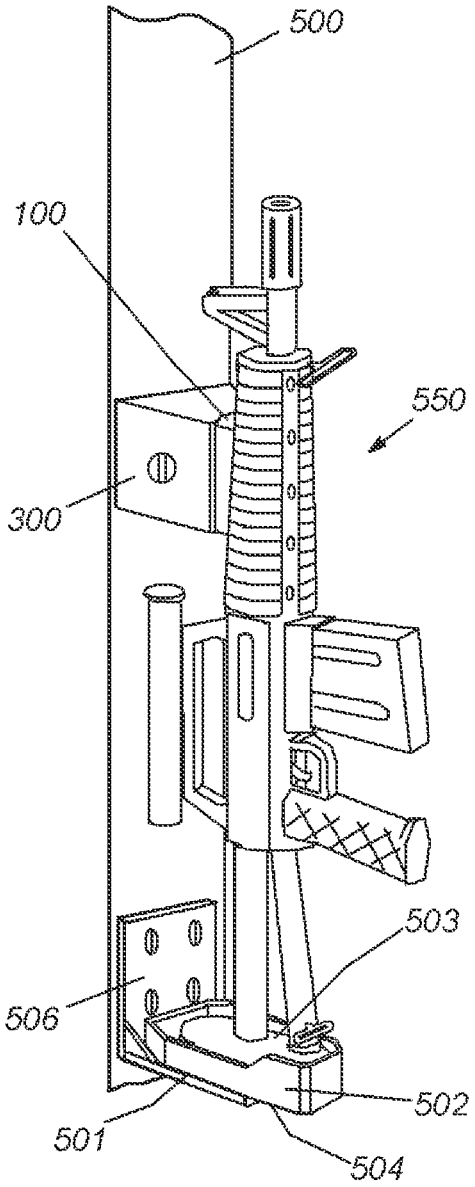
FIG. 5 is a perspective view of a mounting base assembly with an enclosed weapons system, secured to a structural member, according to the illustrative embodiment.

FIG. 5 depicts the exemplary weapons lock mounted to a structural member which has been loaded from a previous configuration to contain a retained weapon 550. An exemplary mounting base 300 is affixed to a structural member 500 that can be part of a structure or a vehicle. In this embodiment, the structural member 500 is depicted as vertical to the general horizon in its orientation, but it can variously be oriented horizontally, at an angle or overhead. The butt of the weapon can be supported by a butt mount assembly 501 that is constructed with an enclosing wall 502 that can be constructed and arranged according to a general or particular weapon stock butt that creates a socket 503 and a base 504 for receiving the weapon butt. The butt mount assembly 501 is affixed to the structural member 500 by a mounting bracket 506. The removal of the butt mount assembly does not affect the security of the enclosed weapon and therefore, the mounting bolts for the butt mount assembly 501 do not have to be concealed or rendered inaccessible. In other embodiments, the mounting base assembly 300 and the butt mount assembly can be welded to a metallic structural member.

Figure 6:
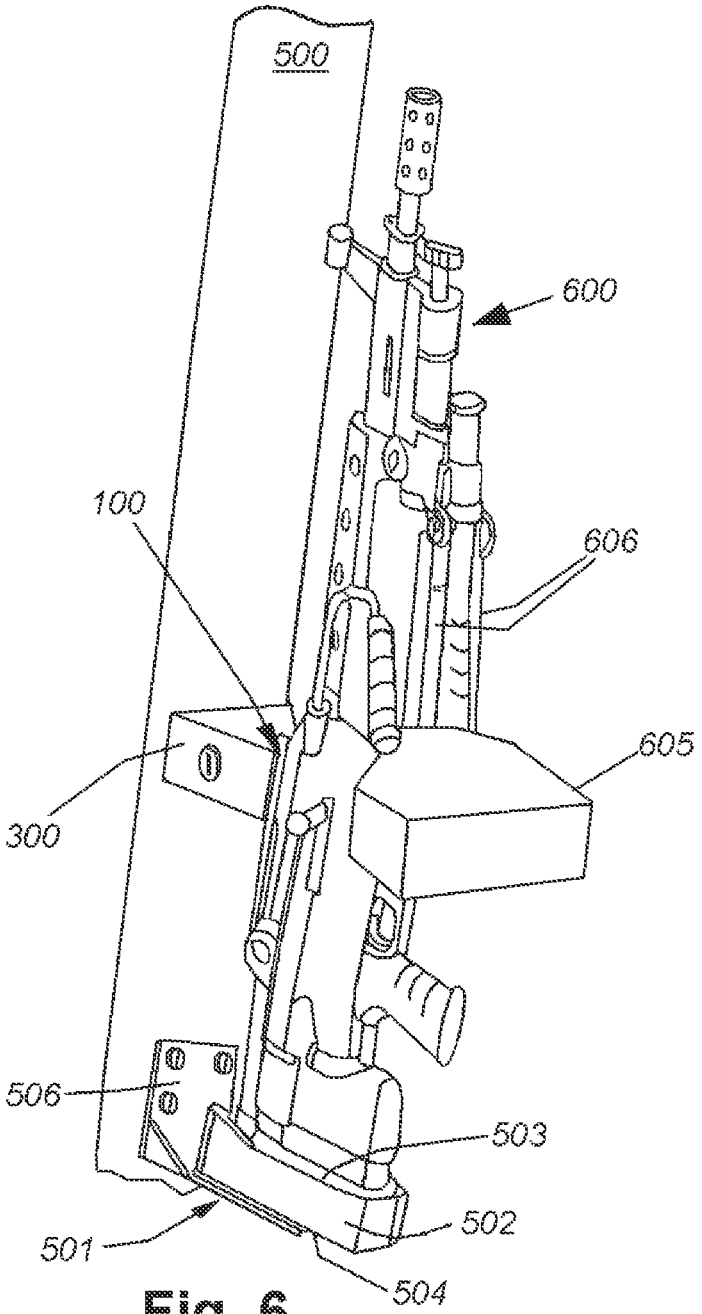
FIG. 6 is a perspective view of a mounting base assembly with an enclosed automatic weapons system, secured to a structural member, according to the illustrative embodiment.

In FIG. 6 a riser assembly 100 attached to the top rail 602 is engaged with and secured to the mounting base assembly 300 contains an automatic weapons system 600 with a box-style ammunition magazine 605 and folded bipod 606 (for example, a M249 Squad Automatic Weapon with an appropriate rail system). The stock butt 604 resides in the socket 503 of the butt mount assembly 501. The weapons system 600 is secured until the base is unlocked and the weapons system 600 is withdrawn by sliding it out of the mounting base assembly 300 by interaction of the riser assembly 100 and the groove 311. The riser assembly does not impede the ammunition magazine or folded components. In other embodiments, weapons having a rail system and an affixed riser assembly, including crew served weapons, multi-barreled grenade launchers, grenade launchers with revolving cylinders, medium and heavy machine guns and other specialized lethal and/or non-lethal weapons can be stored vertically in the weapons lock. It is further contemplated that more than one riser assembly can be attached to a rail system for heavier weapons, and that more than one mounting base can be arranged, end to end (with or without separation therebetween), for greater security and stability of the stored weapon.

Figure 7:
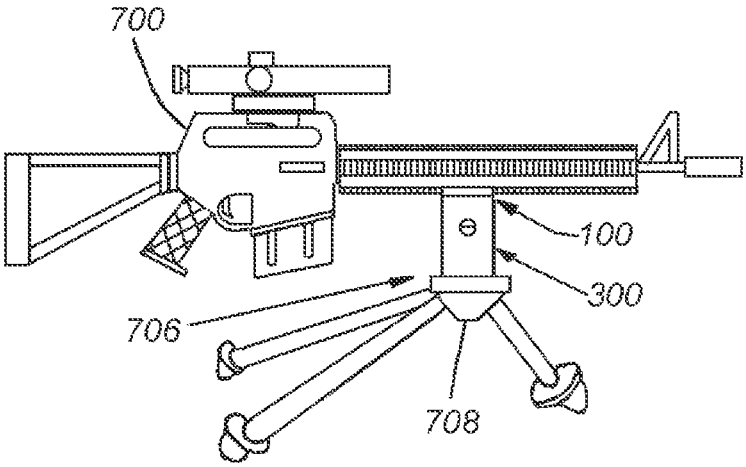
FIG. 7 is a side view of the riser assembly attached to a weapons system and a tripod mount, according to the illustrative embodiment.

FIG. 7 shows an illustrative weapons system 700 with an attached riser assembly 100. The attachment of the riser assembly 100 to the weapons system 700 is as set forth above. The riser assembly 100 is removably engaged with the mounting base assembly 300. The mounting base assembly 300 is secured to the top of a tripod 706 and is anchored on the tripod head 708 with bolts and/or welding. In this configuration, the firearms lock is used as a removable connector and the weapons system 700 is readily removable from the tripod by disengaging the riser assembly from the mounting base assembly.

Figure 8:
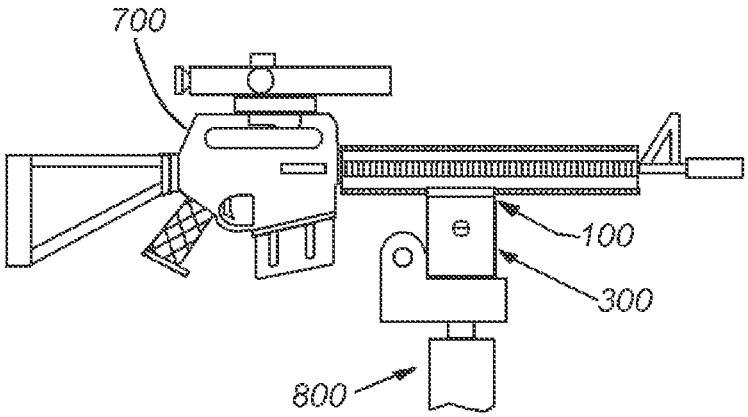
FIG. 8 is a side view of the riser assembly attached to a weapons system and a pintle mount, according to the illustrative embodiment.

FIG. 8 is a further embodiment that shows the illustrative weapons system 700 with attached riser assembly 100 that is removably engaged with the mounting base assembly that is anchored to a pintle mount assembly 800. The pintle mount assembly 800 can be integrated into a vehicle and/or vessel and allows free traverse and elevation. The mounting configurations as depicted in FIGS. 7 and 8 are applicable to paramilitary, military or general security operations. It is expressly contemplated that the mounting base assembly can be anchored to other operational accessory supports in other arrangements. An operational accessory support arrangement is defined as a pintle mount, a tripod, a bipod, or other mount that removably secures the weapon and provides greater fire control.

Figure 9:
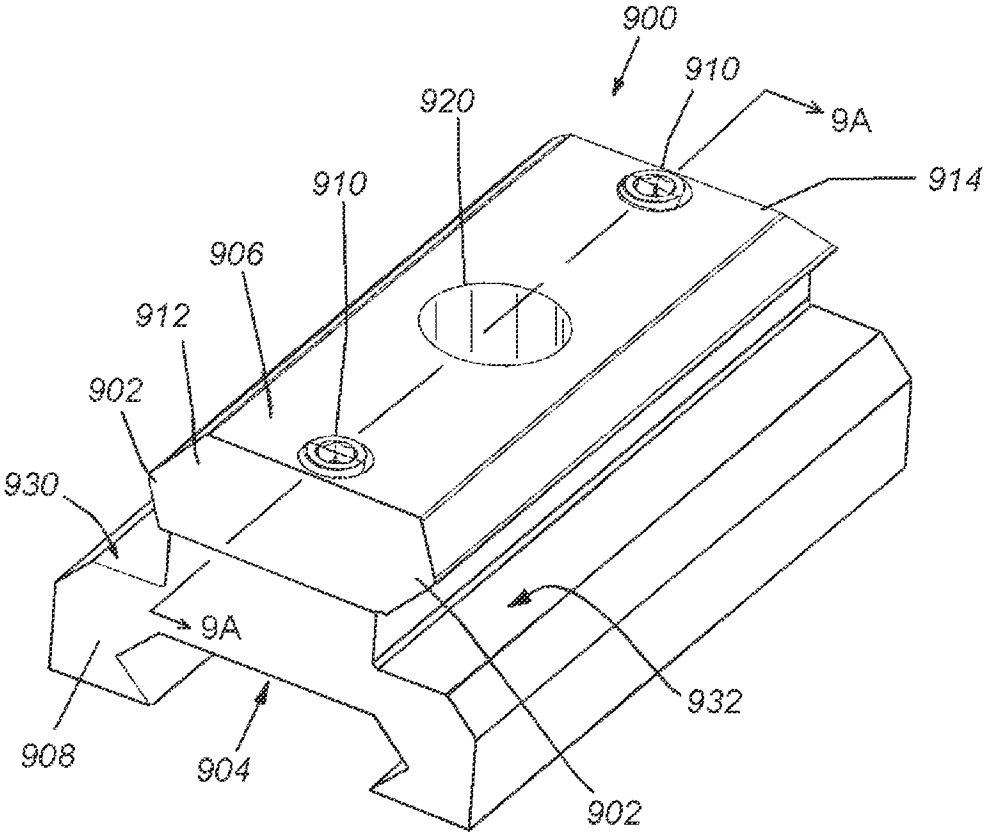
FIG. 9 is a perspective view of a riser, according to an illustrative embodiment.

FIG. 9 is a perspective view of a riser, showing an illustrative riser 900 that is provided with shoulders 902 for removably engaging a riser system, as set forth above. The riser 900 defines a bottom groove 904. The top block 906 is connected with the bottom block 908 by a pair of bolts 910 that are depicted as compatible with an Allen wrench. In other embodiments, fastener bolts having a Phillips head or another such head can be provided. The front face 912 and rear face 914 of the top block 906 and beveled for ease of insertion and removal with a rail system and/or rail system accessory. A central well 920 extends into the top block 906. The well 920 is constructed and arranged to receive the insertion of various mechanisms or devices, for example, a sling swivel. The riser 900 can be constructed of a variety of materials, and combinations and alloys thereof, including aircraft grade aluminum. Faces 930, 932 extend along the sides of the bottom block 908 and provide an engaging surface, as will be explained further below.

Figure 9A:
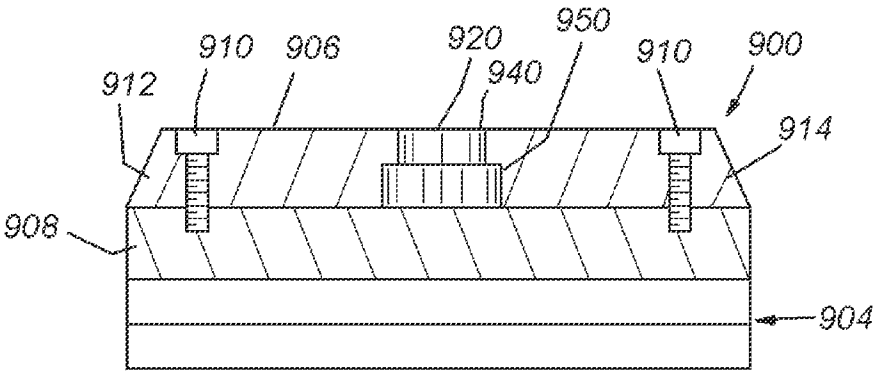
FIG. 9A is a cross-section view along the lines 9A-9A of FIG. 9, according to the illustrative embodiment.

FIG. 9A is a cross section view of the riser 900. The bolts 910 are shown as extending through the top block 906 into the bottom block 908. The central well 920 extends into the top block 906. The central well is undercut so that the end closest to the bottom block 908 is wider in diameter that the opening 940, creating a shoulder 950. This shoulder 950 creates a holding structure for pins and bolts that are provided with a spring-loaded detent ball, for example, a sling mount. The central well 920 can receive and retain a pin, bolt or other engaging structure.

Figure 10:
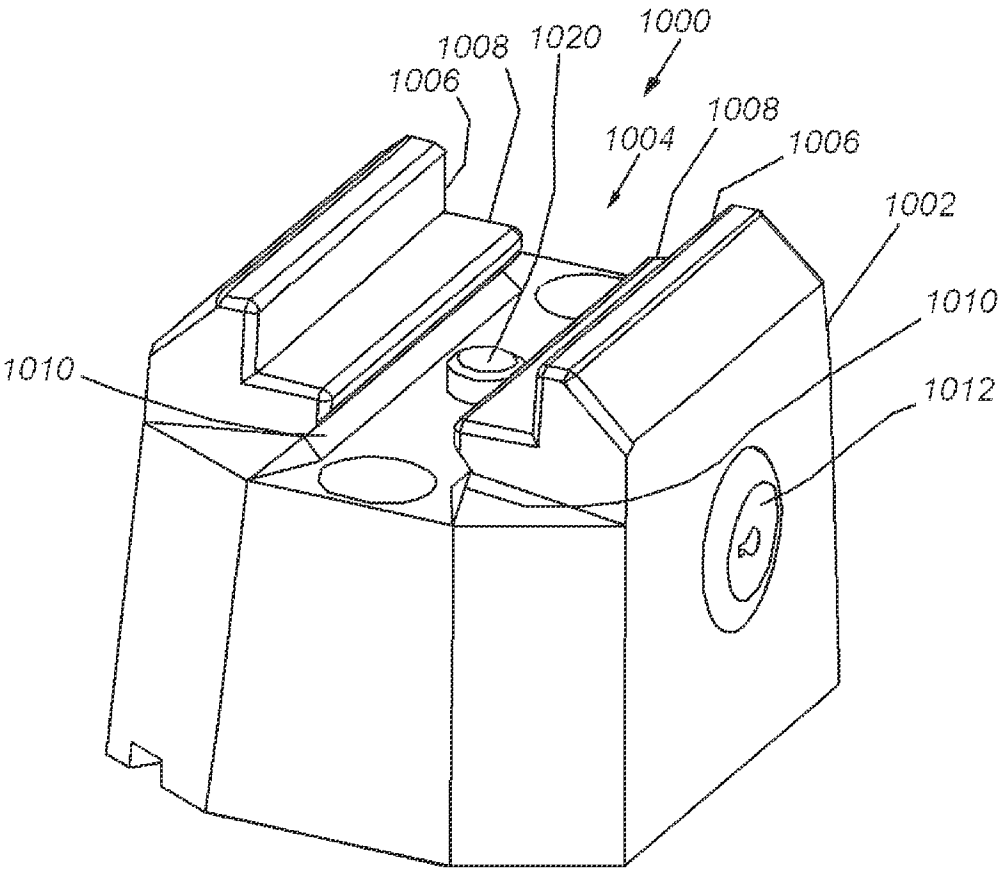
FIG. 10 is a perspective view of a mounting base, according to an illustrative embodiment.

FIG. 10 is a perspective view of a mounting base 1000 for engagement with the riser 900. The base 1000 is constructed and arranged as a solid body 1002 with a machined central groove 1004 for engaging with a riser (not shown). The central groove is provided with sidewalls 1006 and a pair of faces 1008 that interengage with riser faces 930, 932. When the riser is slid into the base at the groove 1004, riser shoulders 902 pass along through respective grooves 1010 and the riser faces 930, 932 are in proximity with base faces 1008. A tumbler 1010 functions as the locking tumbler system 320 above and actuates a tumbler bolt 1020 that is sized and arranged to enter and hold the riser at its central well 920, creating a removable locked structure. As noted above, the riser system can be used to lock a weapon system to a pintle mount or other mount. Mounting base 1000 is an example of a mounting base that can be used in such a system.

Figure 11:
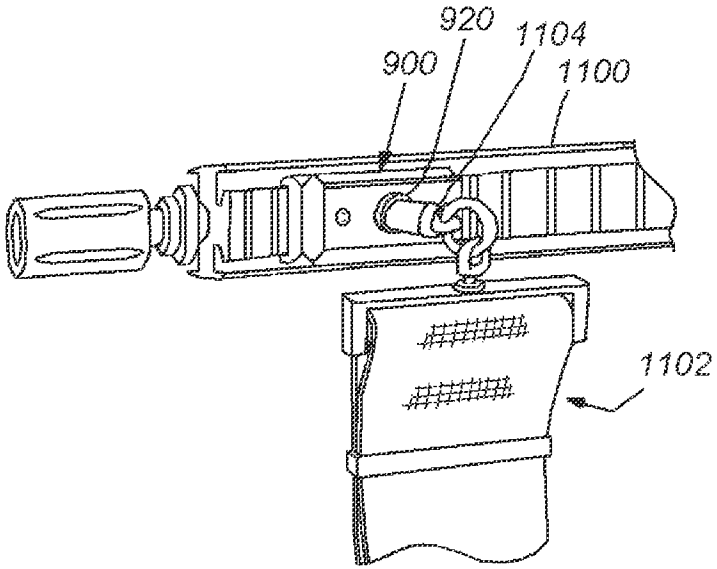
FIG. 11 is a view of a riser with an attached sling, according to an illustrative embodiment.

FIG. 11 is a view of a riser 900 affixed to the end of an illustrative weapons system 1100 with an attached weapons sling 1102. A sling swivel pin 1104 has been inserted into the riser central well 920 and the detent is holding the swivel pin 1104 in the central well until the detent is disengaged. This creates a removable sling mount that is readily actuated. In other embodiments, the central well 920 can receive a pin having a detent mechanism that is attached to a pistol grip or another accessory. To attach and detach the sling, a user inserts the swivel pin 1104 into the central well. The detent mechanism in the swivel pin applies a spring force to push a detent ball into the well below the shoulder 950 so that the pin is held within the central well against the shoulder. Sling removal follows the attachment steps in reverse order, beginning with actuating the detent and removing the swivel pin from the central well to remove the sling. The pin can be adapted to a standard size form-factor, such as a ⅜ inch diameter pin and socket used with commercially available accessories.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. More generally, as used herein the directional terms, such as, but not limited to, "up" and "down", "top" and "bottom", "inside" and "outer", "front" and "back", "inner" and "outer", "interior" and "exterior", "downward" and "upward", "horizontal" and "vertical" should be taken as relative conventions only, rather than absolute indications of orientation or direction with respect to a direction of the force of gravity. Furthermore, while the foregoing describes a number of separate embodiments of the apparatus and method of the present invention, what has been described herein is merely illustrative of the application of the principles of the present invention. For example, the riser assembly can be mounted onto a side rail so that the weapon system is held with its side against the wall. The riser assembly can be attached to a non-weapons piece of equipment (for example, a fire extinguisher or a Geiger counter) for secure and convenient mounting. The mounting base assembly can be attached to a pintle mount so that the weapons system can be removably secured to the pintle mount for operational use. The locking system on the mounting base can be operated by a non-electronic release and/or a thumb release in other embodiments. More that one riser assembly can be affixed to the rails of a single weapon for variable mounting. The weapons system can be a handgun or non-lethal device having a rail mount system. The riser assembly can be attached to an operations bag containing equipment for an operation for securement. Accordingly, this description is meant to be taken only by way of example, and not to otherwise limit the scope of this invention.

What is claimed is:

1. A firearms attachment system for a weapon comprising:

a riser assembly defining a rail receiving slot for receiving a weapon rail system, the riser assembly defining a guide hole and a well;

at least one retaining bolt that passes through the guide hole to engage with a rail of the weapon rail system;

a mounting base assembly having a base and a locking assembly, the base defining a groove that engages with and receives the riser assembly and being securable to a structural member; the locking assembly comprising a tumbler bolt, the tumbler bolt sized and arranged to insert into the well, and the locking assembly selectively securing the riser assembly with respect to the base in a closed position when the tumbler bolt is inserted into the well.

2. The firearms attachment system of claim 1, wherein the rail receiving slot is open along its top, resides upon a base shoulder mount and is bordered along its sides by opposing riser shoulders.

3. The firearms attachment system of claim 1, wherein the riser assembly is removably attachable to the rail of a weapon rail system by connection of the weapon system rail with the rail receiving slot.

4. The firearms attachment system of claim 2, wherein the riser assembly is removably attached to a bottom rail of the weapon rail system by connection of the weapon system rail with the rail receiving slot.

5. The firearms attachment system of claim 2, wherein the riser assembly is removably attached to a top rail of the weapon rail system by connection of the weapon system rail with the rail receiving slot.

6. The firearms attachment system of claim 3, wherein the riser assembly is removably attached to a side rail of the weapon rail system by connection of the weapon system rail with the rail receiving slot.

7. The firearms attachment system of claim 1, wherein the riser assembly is removably attached to a mounting base assembly that is anchored to an operational accessory support arrangement.

8. The firearms attachment system of claim 1, wherein the riser assembly defines a central well.

9. The firearms attachment system of claim 8, wherein the central well is configured to receive and retain a mount for a weapons sling.

* * * * *